US008705761B2

(12) United States Patent
Gelhard et al.

(10) Patent No.: US 8,705,761 B2
(45) Date of Patent: Apr. 22, 2014

(54) ENTERTAINMENT SYSTEM AND EARPHONE

(75) Inventors: Oliver Gelhard, Hannover (DE); Christian Grone, Neustadt (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 749 days.

(21) Appl. No.: 12/554,461

(22) Filed: Sep. 4, 2009

(65) Prior Publication Data

US 2010/0061563 A1 Mar. 11, 2010

(30) Foreign Application Priority Data

Sep. 8, 2008 (DE) ..... 10 2008 046 048

(51) Int. Cl.
*H04R 1/10* (2006.01)

(52) U.S. Cl.
USPC ..... 381/74; 381/122; 381/92; 381/71.4; 381/86

(58) Field of Classification Search
USPC ..... 381/74, 314, 316, 317, 318, 381/71.1–71.14, 86, 92, 93, 94.1, 94.2, 381/94.3–94.7, 95, 98, 97, 100, 119, 122, 381/91, 26, 309, 323, 72, 370, 375, 334, 381/101, 102, 103, 120, 28, 302; 700/94; 379/3, 406.06, 406.07, 406.08, 406.09, 379/406.1, 406.12, 406.13, 406.14
See application file for complete search history.

(56) References Cited

U.S. PATENT DOCUMENTS

| | | | | |
|---|---|---|---|---|
| 3,970,787 | A * | 7/1976 | Searle | 381/310 |
| 2004/0240692 | A1 * | 12/2004 | Julstrom | 381/315 |
| 2008/0044004 | A1 * | 2/2008 | Keehr | 379/431 |
| 2009/0041259 | A1 | 2/2009 | Grandt | |

FOREIGN PATENT DOCUMENTS

WO WO 2004002383 A1 * 1/2004

* cited by examiner

*Primary Examiner* — Xu Mei
*Assistant Examiner* — Leshui Zhang
(74) *Attorney, Agent, or Firm* — Kilpatrick Townsend & Stockton LLP

(57) ABSTRACT

There is provided an entertainment system comprising at least one seat, an electronic unit (100) for active noise reduction in the seat and at least one headphone (300). The headphone has an electro-acoustic reproduction transducer (310), a microphone (330) for recording interference signals and an adjusting unit (320) having an active filter for correcting a frequency response characteristic of the output signal of the microphone, for performing pre-filtration for active noise reduction and for the output of a corrected and filtered signal. The electronic unit (100) performs active noise reduction based on the corrected and filtered signal of the adjusting unit (320).

3 Claims, 1 Drawing Sheet

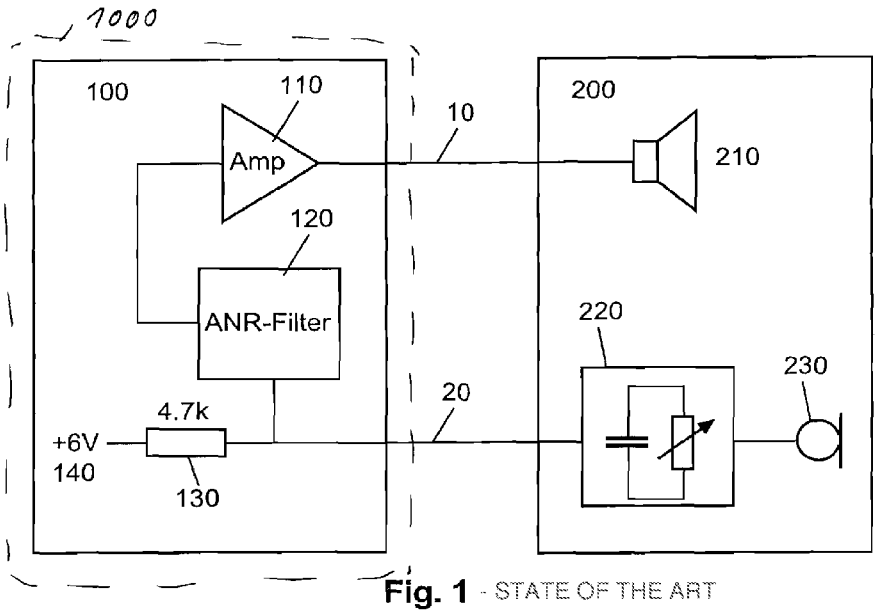
Fig. 1 - STATE OF THE ART
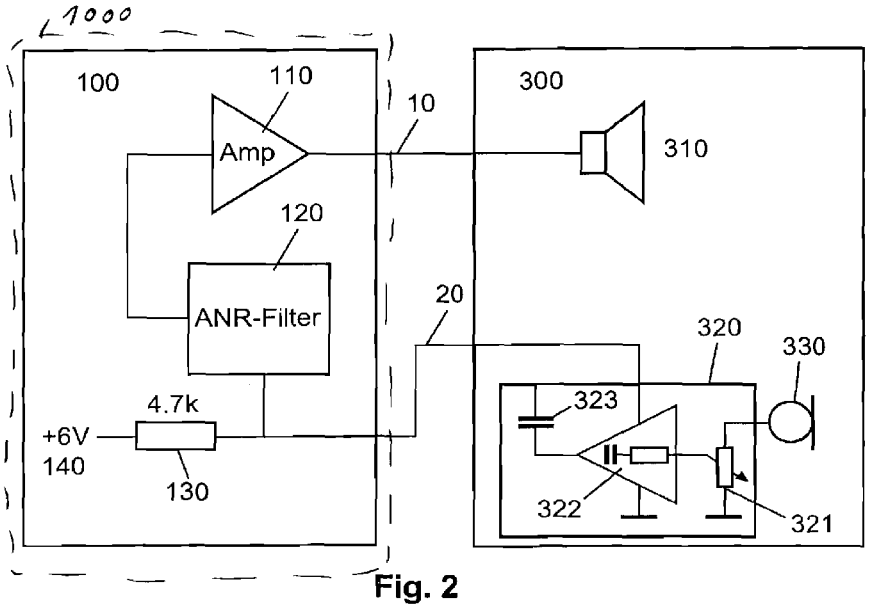
Fig. 2

ENTERTAINMENT SYSTEM AND EARPHONE

CROSS-REFERENCE TO RELATED APPLICATIONS

This application claims priority to German Patent Application No. 102008046048.6, filed Sep. 8, 2008, the disclosure of which is incorporated herein by reference in its entirety.

The present invention concerns an entertainment system and an earphone.

Inflight entertainment systems are used for example in aircraft, wherein at least one headphone connection as well as operating elements for the selection of an audio channel are typically provided on a seat. In more recent inflight entertainment systems, typically an LCD screen is provided either in the backrest of a seat in front or such a screen is provided in the seat in such a way that it can be folded away. In addition thereto, the system includes operating elements to be able to suitably select the audio and video channels. To improve the quality of reproduction by headphones used, a noise-reducing headphone for example can be provided. In that case the electronic system required for noise reduction can be provided both in the headphone and also in the seat.

DE 10 2005 016204 discloses a headphone with a noise reduction unit arranged for example in a seat.

With inflight entertainment systems in which the noise reduction electronics are arranged in the seat, it can happen that the acoustics of the headphone used do not match the noise reduction electronic system employed.

Thus an object of the present invention is to provide an entertainment system in which any headphone, that is to say with any acoustics, can be used.

That object is attained by an entertainment system as set forth in claim 1, by an earphone as set forth in claim 3 and by a method as set forth in claim 4.

Thus there is provided an entertainment system with at least one seat, an electronic unit for active noise reduction in the seat and at least one phone, for example a headphone, an earphone or an in-ear phone. The headphone has an electro-acoustic reproduction transducer, a microphone for recording interference signals and an adjusting unit having an active filter for correcting a frequency response characteristic of the output signal of the microphone, for effecting pre-filtering for active noise reduction and for outputting a corrected and filtered signal. The electronic unit performs active noise reduction based on the corrected and filtered signal of the adjusting unit.

In accordance with an aspect of the present invention the electronic unit has a filter for active noise reduction and an amplifier for amplifying the actively noise-reduced signal. The filtered and corrected signal of the adjusting unit is fed to the filter in the electronic unit.

The invention also concerns an earphone having an electro-acoustic transducer, a microphone for recording interference signals and an adjusting unit having an active filter. The adjusting unit serves to receive the output signal of the microphone, to correct the frequency response characteristic of the output signal, to perform pre-filtering for active noise reduction and to output the filtered and compensated signal.

The invention also concerns a method of controlling an entertainment system having at least one seat, an electronic unit for active noise reduction in the seat and at least one headphone having an electro-acoustic reproduction transducer, a microphone for recording interference signals and an adjusting unit having an active filter. By means of the active filter, the frequency response characteristic of the output signal is corrected, pre-filtering for active noise reduction is effected and the corrected and filtered signal is outputted. Active noise reduction is effected based on the corrected and filtered signal.

The invention concerns the concept of providing an active filter in a headphone or earphone, which is fed by a microphone supply voltage which is fed for example by the noise reduction electronic system in a seat. The filter in the earphone serves in that case to adjust the noise reduction function of the earphone in the way as is present in the case of an earphone with standard noise reduction. Preferably the filter is adapted to save on current as the supply voltage is coupled to a 4.7 kOhms resistor.

Further configurations of the invention are subject-matter of the appendant claims.

Embodiments by way of example and advantages of the invention are described in greater detail hereinafter with reference to the drawing.

FIG. 1 shows a block diagram of a part of an entertainment system in accordance with the state of the art, and FIG. 2 shows a block diagram of a part of an entertainment system in accordance with a first embodiment.

FIG. 1 shows a block diagram of a part of an inflight entertainment system in accordance with the state of the art. The inflight entertainment system has a multiplicity of electronic units 100 in seats 1000 and (head) phones 200. The electronic unit 100 and the (head) phone 200 are connected together by first and second lines 10, 20. Provided in the headphone 200 is an electro-acoustic reproduction transducer 210, a microphone 230 and an adjusting unit 220 with a filter. The microphone 230 is coupled to the filter and the adjusting unit 220, the output of the adjusting unit 220 being coupled to the electronic unit 100 by way of the second line 20. The adjusting unit 220 has a passive filter or a compensating resistor and an RL member. The electronic unit 100 has a voltage supply 140 of for example+6 volts. The electronic unit 100 further has an ANR filter 120 and an audio amplifier 110. The ANR filter 120 performs noise reduction based on the audio signals recorded by the microphone 230. The output of the amplifier 110 is coupled to the electro-acoustic transducer 210 by way of the first line 10.

FIG. 2 shows a block diagram of a part of an inflight entertainment system in accordance with a first embodiment. In this case the electronic unit 100 of the first embodiment substantially corresponds to the electronic unit in accordance with the state of the art. FIG. 2 also shows a headphone or earphone 300 having an electro-acoustic reproduction transducer 310 and a microphone 330, for example an electret microphone, which serves to record interference sound. In addition thereto the headphone or earphone 300 has an adjusting unit 320. The adjusting unit 320 can have for example an adjustable input resistor 321, an amplifier 322 and optionally a capacitor 323. The output of the adjusting unit 320 is coupled by way of the second line 20 to a first terminal of the electronic unit. The microphone receives a supply voltage by way of the first terminal.

The adjusting unit serves as a pre-filter for active noise reduction. In other words, it is possible to achieve distributed active noise reduction, in which case a part is implemented in the seat and a part in the earphone. It is possible to provide in that way that active noise reduction is adapted to the specific acoustics of the earphone. Thus the adjusting unit 320 serves as a pre-filter, while further filtering and in particular the required amplification effect takes place in the ANR filter 120.

The adjusting unit 320 also serves for correction of the transmission behaviour of the earphone and can provide for improved matching of the distributed active noise reduction to the acoustics of the earphone.

Optionally the adjusting unit 320 can also amplify the output signal of the microphone.

The invention claimed is:

1. An entertainment system comprising:

at least one seat;

at least one electronic unit for active noise reduction, arranged in the at least one seat; and at least one earphone having specific acoustics and having:

an electro-acoustic reproduction transducer for outputting an audio signal;

a microphone for recording interference signals and for outputting an output signal of the microphone; and an adjusting unit having an active filter for performing pre-filtration of the output signal of the microphone and for outputting a filtered microphone signal, wherein the at least one electronic unit comprises a microphone voltage supply for providing a supply voltage, and wherein the at least one electronic unit is adapted to perform active noise reduction based on the filtered microphone signal of the adjusting unit, and wherein the at least one electronic unit and the at least one earphone are coupled via a first connection and a second connection, and wherein the second connection serves to provide the supply voltage to the at least one earphone and to forward the filtered microphone signal from the at least one earphone to the at least one electronic unit, and wherein the pre-filtration performed by the adjusting unit provides improved matching of the at least one electronic unit for active noise reduction to the specific acoustics of the at least one earphone by correcting a frequency response characteristic of the output signal of the microphone, and wherein the active filter in the adjusting unit comprises an amplifier, and wherein the supply voltage serves to supply both the microphone and the active filter.

2. An earphone having specific acoustics comprising:

at least one electro-acoustic transducer for outputting an audio signal;

a microphone for recording interference signals and for outputting an output signal of the microphone; and an adjusting unit having an active filter for performing pre-filtration of the output signal of the microphone and for outputting a filtered microphone signal, wherein the earphone is configured to connect to an electronic unit for active noise reduction via a first connection and a second connection, and wherein the electronic unit comprises a microphone voltage supply for providing a supply voltage, and wherein the second connection serves to provide the supply voltage to the earphone and to forward the filtered microphone signal from the earphone to the electronic unit, and wherein the pre-filtration performed by the adjusting unit provides improved matching of the electronic unit for active noise reduction to the specific acoustics of the earphone by correcting a frequency response characteristic of the output signal of the microphone, and wherein the active filter in the adjusting unit comprises an amplifier, and wherein the supply voltage serves to supply both the microphone and the active filter.

3. A method of controlling an entertainment system comprising at least one seat, at least one electronic unit for active noise reduction in the at least one seat and at least one earphone having specific acoustics and having a microphone for recording interference signals and having an adjusting unit, comprising the steps:

connecting the at least one earphone to the at least one electronic unit via a first connection and a second connection;

providing a supply voltage in the at least one electronic unit and providing the supply voltage to the at least one earphone via the second connection;

feeding the supply voltage to both the microphone and the adjusting unit;

generating an output signal of the microphone by recording interference signals with the microphone;

performing active pre-filtration of the output signal of the microphone in the adjusting unit for providing a filtered microphone signal;

forwarding the filtered microphone signal from the at least one earphone to the at least one electronic unit via the second connection;

performing active noise reduction based on the filtered microphone signal in the at least one electronic unit, wherein the active pre-filtration performed by the adjusting unit provides improved matching of the at least one electronic unit for active noise reduction to the specific acoustics of the at least one earphone by correcting a frequency response characteristic of the output signal of the microphone, and wherein the adjusting unit comprises an amplifier.

* * * * *